US011105500B2

(12) United States Patent
Yuan et al.

(10) Patent No.: US 11,105,500 B2
(45) Date of Patent: Aug. 31, 2021

(54) FILM TEMPERATURE OPTIMIZER FOR FIRED PROCESS HEATERS

(71) Applicant: UOP LLC, Des Plaines, IL (US)

(72) Inventors: Quan Yuan, Buffalo Grove, IL (US); Rajeswar Gattupalli, Buffalo Grove, IL (US); Matthew Martin, Tulsa, OK (US); Michael J. Vetter, Schaumburg, IL (US)

(73) Assignee: UOP LLC, Des Plaines, IL (US)

( * ) Notice: Subject to any disclaimer, the term of this patent is extended or adjusted under 35 U.S.C. 154(b) by 115 days.

(21) Appl. No.: 16/735,096

(22) Filed: Jan. 6, 2020

(65) Prior Publication Data

US 2020/0141569 A1 May 7, 2020

Related U.S. Application Data

(63) Continuation of application No. 15/796,729, filed on Oct. 27, 2017, now Pat. No. 10,551,053, which is a continuation of application No. PCT/US2016/038534, filed on Jun. 21, 2016.

(60) Provisional application No. 62/186,717, filed on Jun. 30, 2015.

(51) Int. Cl.

| | |
|---|---|
| ***F22B 35/10*** | (2006.01) |
| ***F23C 5/28*** | (2006.01) |
| ***F23C 3/00*** | (2006.01) |

(52) U.S. Cl.

CPC ..... *F22B 35/10* (2013.01); *F23C 3/00* (2013.01); *F23C 5/28* (2013.01)

(58) Field of Classification Search

CPC ..... F22B 35/10

See application file for complete search history.

(56) References Cited

U.S. PATENT DOCUMENTS

| | | | | |
|---|---|---|---|---|
| 2,338,295 A | | 4/1941 | Mekler | |
| 3,407,789 A | * | 10/1968 | Hallee | C10G 9/20 122/356 |
| 3,924,574 A | | 12/1975 | Ebeling | |
| 4,160,701 A | | 7/1979 | Dorner et al. | |
| 4,492,624 A | | 1/1985 | Johnson et al. | |
| 4,906,442 A | * | 3/1990 | Johnson | C10G 9/14 165/184 |
| 5,147,511 A | | 9/1992 | Woebcke | |
| 5,151,158 A | | 9/1992 | Bowen et al. | |
| 5,181,990 A | | 1/1993 | Arisaki et al. | |

(Continued)

FOREIGN PATENT DOCUMENTS

| | | |
|---|---|---|
| RU | 2052733 C1 | 1/1996 |
| RU | 2256127 C1 | 7/2005 |

OTHER PUBLICATIONS

International Search Report from PCT application No. PCT/US2016/038534 dated Sep. 15, 2016.

(Continued)

*Primary Examiner* — Nathaniel Herzfeld

(57) ABSTRACT

A fired heater with a film temperature optimizer is presented. The fired heater is for heating a process fluid in process coils within the fired heater. The process coils experience high temperatures at the outlets. The film temperature optimizer includes baffles or means for changing the flow of the fired heating gas around the process coils near the coil outlets. The baffles are positioned near the process coil outlets.

12 Claims, 4 Drawing Sheets

(56) References Cited

U.S. PATENT DOCUMENTS

| | | | | |
|---|---|---|---|---|
| 5,271,827 | A * | 12/1993 | Woebcke | C10G 9/002 208/132 |
| 8,282,814 | B2 * | 10/2012 | Peters | C10G 29/205 208/63 |
| 8,631,769 | B1 | 1/2014 | Kirakossian | |
| 9,205,400 | B2 * | 12/2015 | He | B01J 19/2425 |
| 2008/0142411 | A1 * | 6/2008 | Barendregt | C10G 9/36 208/132 |
| 2012/0227681 | A1 | 9/2012 | Min | |

OTHER PUBLICATIONS

Written Opinion from from PCT application No. PCT/US2016/038534 dated Sep. 5, 2016.
International Preliminary Report on Patentability from PCT application No. PCT/US2016/038534, dated Jan. 2, 2018.

* cited by examiner

FILM TEMPERATURE OPTIMIZER FOR FIRED PROCESS HEATERS

CROSS-REFERENCE TO RELATED APPLICATIONS

This application is a Continuation of U.S. patent Ser. No. 15/796,729 filed on Oct. 27, 2017, which is a continuation of International Application No. PCT/US2016/038534 filed Jun. 21, 2016 which claims benefit of U.S. Provisional Application No. 62/186,717 filed Jun. 30, 2015, the contents of which cited applications are hereby incorporated by reference in their entirety.

FIELD OF THE INVENTION

The present invention relates to fired heaters for use in chemical processes.

BACKGROUND

Fired heaters are common process units in chemical plants. The fired heaters heat process streams to reaction temperatures, and provide heat to process streams that have endothermic reactions. A fired heater has a general configuration of a tube for carrying a process fluid inside a shell wherein burners are used to combust a fuel to heat the tubes.

Fired heaters occupy significant space, and the fired heaters often heat the process fluids above desired temperatures. With more complex processes, and with upgrades to processes in chemical plants, new configurations are needed to reduce the area taken up by fired heaters, to control the outlet temperatures of process fluids, and to provide for new efficiencies in the heating of process fluids.

SUMMARY

The present invention is a fired heater with film temperature optimizers for limiting the peak temperatures in the process unit heating coils.

A first embodiment of the invention is an apparatus for a process fired heater comprising a shell having sides, an upper surface, a lower surface, combustion fluid inlets and a flue gas outlet; at least one process coil comprising two inlet ports and one outlet port, and disposed within the shell and having the inlet ports and outlet port disposed on the upper surface of the shell; at least two burners disposed on the sides of the shell; and at least two baffles disposed within the shell and positioned on the upper surface of the shell and between the burners and the process coil outlet port. An embodiment of the invention is one, any or all of prior embodiments in this paragraph up through the first embodiment in this paragraph wherein the process coil has a configuration of three tubes in a parallel orientation, with two semi-circular tubular sections connecting the ends of the tubes, such that the tubes and tubular sections form a W-shaped coil, and the two inlet tubes having one end connected to an inlet port and the central outlet tube having one end connected to the outlet port. An embodiment of the invention is one, any or all of prior embodiments in this paragraph up through the first embodiment in this paragraph, wherein upper surface further includes a refractory material on the upper surface, inside the shell and abutting the baffles. An embodiment of the invention is one, any or all of prior embodiments in this paragraph up through the first embodiment in this paragraph wherein the shell has a substantially rectangular prismatic shape, with a height, a depth and a width, and wherein the process coils extend at least 70% of the height, and the process coils are arranged across the width with the central tubes arrayed along an axis that is in the middle of the width of the shell, and wherein the smaller tubes are arrayed in a position between 5% and 95% of the distance of the half-width of the shell. An embodiment of the invention is one, any or all of prior embodiments in this paragraph up through the first embodiment in this paragraph further comprising an insulating layer on top of the upper surface. An embodiment of the invention is one, any or all of prior embodiments in this paragraph up through the first embodiment in this paragraph wherein the shell has a substantially rectangular prismatic shape, with a height, a depth and a width, and wherein the burners are disposed on opposite sides of the width of the shell, and wherein the burners are disposed within 10% of the height of the from the bottom of the shell. An embodiment of the invention is one, any or all of prior embodiments in this paragraph up through the first embodiment in this paragraph wherein the shell has a substantially rectangular prismatic shape, with a height, a depth and a width, and wherein the burners are disposed on opposite sides of the depth of the shell. An embodiment of the invention is one, any or all of prior embodiments in this paragraph up through the first embodiment in this paragraph wherein the baffles extend between 2% and 15% of the height from the upper surface. An embodiment of the invention is one, any or all of prior embodiments in this paragraph up through the first embodiment in this paragraph wherein the baffles extend between 2% and 10% of the height from the upper surface. An embodiment of the invention is one, any or all of prior embodiments in this paragraph up through the first embodiment in this paragraph wherein the baffles extend between 3% and 9% of the height from the upper surface.

A second embodiment of the invention is an apparatus for a process fired heater comprising a shell having a first end, a second end positioned opposite the first end, and sides connecting the first end and second end, and wherein the sides and ends enclose a space; at least one w-shaped process tube comprising two inlet ports and one outlet port, and disposed within the shell and having the inlet ports and the outlet port on the first end; a flue gas outlet disposed in the second end; and at least two burners disposed on the sides of the shell; wherein the first end of the shell comprises at least two projections from the first end and the projections extend into the enclosed space, and wherein the projections are interposed between an inlet port to the process tube and the outlet port for the process tube. An embodiment of the invention is one, any or all of prior embodiments in this paragraph up through the second embodiment in this paragraph wherein the projections extend between 2% and 15% of the height from the first end. An embodiment of the invention is one, any or all of prior embodiments in this paragraph up through the second embodiment in this paragraph wherein the burners are disposed on opposite sides of the shell. An embodiment of the invention is one, any or all of prior embodiments in this paragraph up through the second embodiment in this paragraph wherein the shell has a height between 12 m and 25 m, and wherein the projections are between 0.3 m and 3 m. An embodiment of the invention is one, any or all of prior embodiments in this paragraph up through the second embodiment in this paragraph wherein the first end is an upper surface of the shell.

A third embodiment of the invention is an apparatus for a process fired heater comprising a shell having sides having a height, an upper surface, and a lower surface which defines a volume, and combustion fluid inlets and a flue gas outlet;

at least one process coil comprising two inlet ports and one outlet port, and disposed within the shell and having the inlet ports and outlet port disposed on the upper surface of the shell; and at least two burners disposed on the sides of the shell in a position below the flue gas outlet; wherein the upper surface comprises a surface with a projection into the volume, wherein the projection extends at least 2% of the height, and wherein the process coil outlet port is disposed on the projection. An embodiment of the invention is one, any or all of prior embodiments in this paragraph up through the third embodiment in this paragraph wherein the projection has a width and a depth, wherein the depth is the projection length into the volume, and width is at least 10% of the distance between the sides of the shell with the burners. An embodiment of the invention is one, any or all of prior embodiments in this paragraph up through the third embodiment in this paragraph wherein the shell has a shell width and the projection has a projection width that is between 10% and 50% of the shell width. An embodiment of the invention is one, any or all of prior embodiments in this paragraph up through the third embodiment in this paragraph wherein the projection extends between 3% and 15% of the height into the volume. An embodiment of the invention is one, any or all of prior embodiments in this paragraph up through the third embodiment in this paragraph wherein the process coil has a configuration of three tubes in a parallel orientation, with two semi-circular tubular sections connecting the ends of the tubes, such that the tubes and tubular sections form a W-shaped coil, and the two inlet tubes having one end connected to an inlet port on the upper surface between the projection and the sides, and the central outlet tube having one end connected to the outlet port disposed on the projection.

Other objects, advantages and applications of the present invention will become apparent to those skilled in the art from the following detailed description and drawings.

DETAILED DESCRIPTION

Chemical processes frequently need heating. Process heaters are designed to heat feed streams or intermediate process streams to temperatures necessary for the chemical reactions in the processes to occur at a reasonable rate. Dual-cell fired process heaters are equipped with "U-shaped" coils that allow for a process fluid to be heated. The coils are mounted in fired heaters that include burners. A fired heater is typically a box-shaped furnace with the coils inside the box and burners mounted on the sides or bottoms of the furnace. For a commercial process, a fired heater can be a very large item.

Fired process heaters often cause non-selective reactions, such as thermal conversion or cracking of hydrocarbons. These non-selective reactions reduce yields and increase losses.

Redesigned heaters can reduce these losses and proved for more desirable capital cost, operation costs and reduced area, or smaller plot space, required for a heater. Newer designed heating coils within the fired heaters reduce the hot volume. However, peak film temperatures of the coils near the outlets can still lead to undesired reactions and subsequent losses. New designs for modifications within the fired heaters reduce the peak film temperatures of the coils.

The present invention is an apparatus for a process fired heater. The heater includes a shell having sides, an upper surface, a lower surface, combustion fluid inlets and a flue gas outlet. The heater includes at least one process coil disposed within the shell for carrying a process fluid to be heated. Each process coil includes two inlet ports, and one outlet port, wherein the inlet and outlet ports are disposed on the upper surface of the shell. The heater further includes at least two burners disposed on the sides of the shell, and at least two baffles disposed within the shell. The baffles are positioned on the upper surface of the shell, and between the burners and the process coil outlet port.

Figure 1:
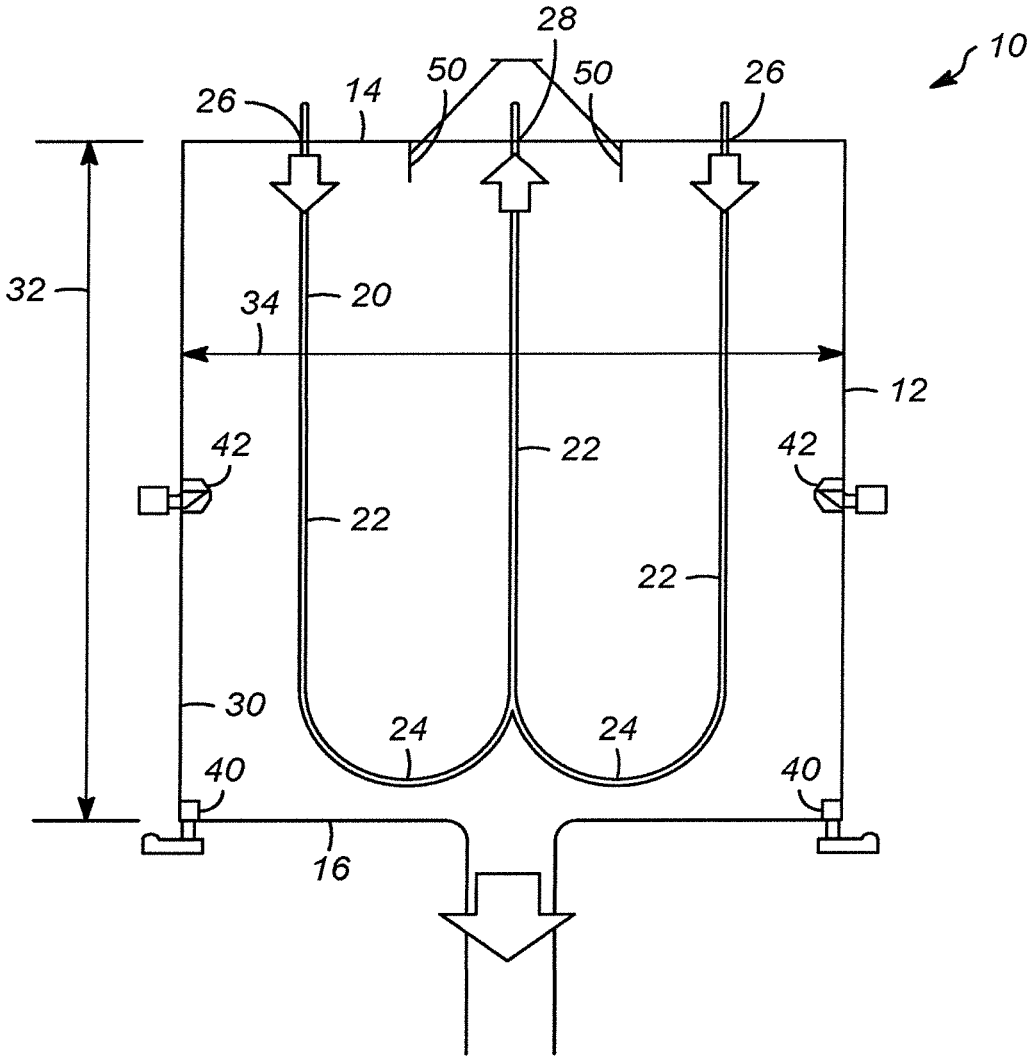
FIG. 1 shows a cross-section of a fired heater with baffles.

A cross-section of the apparatus is shown in FIG. 1, wherein the apparatus 10 has sides 12, an upper surface 14 and a lower surface 16. The apparatus 10 includes a process coil 20, wherein the process coil 20 includes three tubes 22 in a parallel orientation with two rounded tubular sections 24 connecting the ends of the tubes 22. Preferably the rounded tubular sections 24 have a semi-circular shape. The coil 20 forms a W-shaped coil with the two inlet tubes 22 having an end connected to an inlet port 26 and the outlet tube 22 connected to an outlet port 28.

The apparatus 10 includes a shell 30 that has a height 32, a width 34 and a depth (not shown). The process coils 20 are arranged across the width 32 with the outlet tubes arrayed toward the center of the shell 30, and along an axis that is in the middle of the width 34 of the shell, and wherein the axis extends along the depth of the shell. In one embodiment, the coils 20 extend at least 70% of the height 32 of the shell. The inlet tubes are arrayed in a position between 5% and 95% of the distance of the half-width of the shell from the shell sides 12.

The apparatus 10 includes burners 40 disposed on the sides of the fired heater. In one embodiment, the burners are disposed on opposite sides 12 of the width 34 of the shell 30. The burners 40 can be disposed in the lower surface 16, or in the sides 12 and at a position within 10% of the height 32 of the shell from the lower surface 16, or bottom of the shell. In an alternate arrangement, the burners are disposed on opposite sides of the depth of the shell. In one embodiment, the apparatus 10 can include a second set of burners 42 that are disposed in the sides 12 of the shell 30, and at a position between 30% and 80% of the height from the bottom of the shell.

The apparatus 10 further includes baffles 50, or film temperature optimizers, that are disposed between the coil outlet 28 and the burners 40. The baffles 50 extend into the heater volume from the upper surface a distance between 2% and 15% of the height 32 of the shell 30 from the upper surface 14. In one embodiment, the baffles 50 extent a distance between 2% and 10% of the height 32 of the shell 30 from the upper surface 14. In another embodiment, the baffles 50 extend a distance between 3% and 9% of the height 32 of the shell 30 from the upper surface 14. The baffles 50 are sized to change the flow such that the peak film temperature near the outlet 28 of the coil 20 is reduced.

Figure 2:
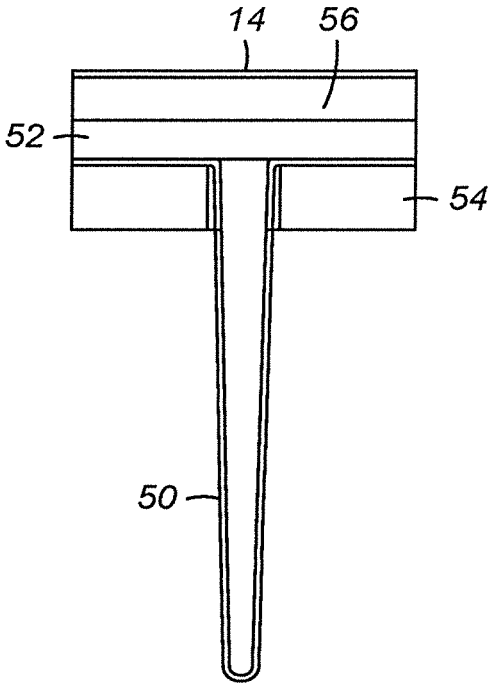
FIG. 2 shows a second embodiment of a baffle in the fired heater.

In one embodiment, as shown in FIG. 2, the baffles 50 are affixed to the upper surface 14. The upper surface includes a refractory material 52 inside the shell and can include a refractory material 54 affixed to hold the baffles 50 to the upper surface 14. The apparatus 10 can further include an insulating layer 56 above the refractory material 52 on the upper surface 14.

In a variation of the above embodiments, the process coils can be affixed to the lower surface, with the baffles disposed on the lower surface between the process coils outlet and the burners. In this variation, the apparatus is essentially an inverted version of the above embodiments.

Figure 3:
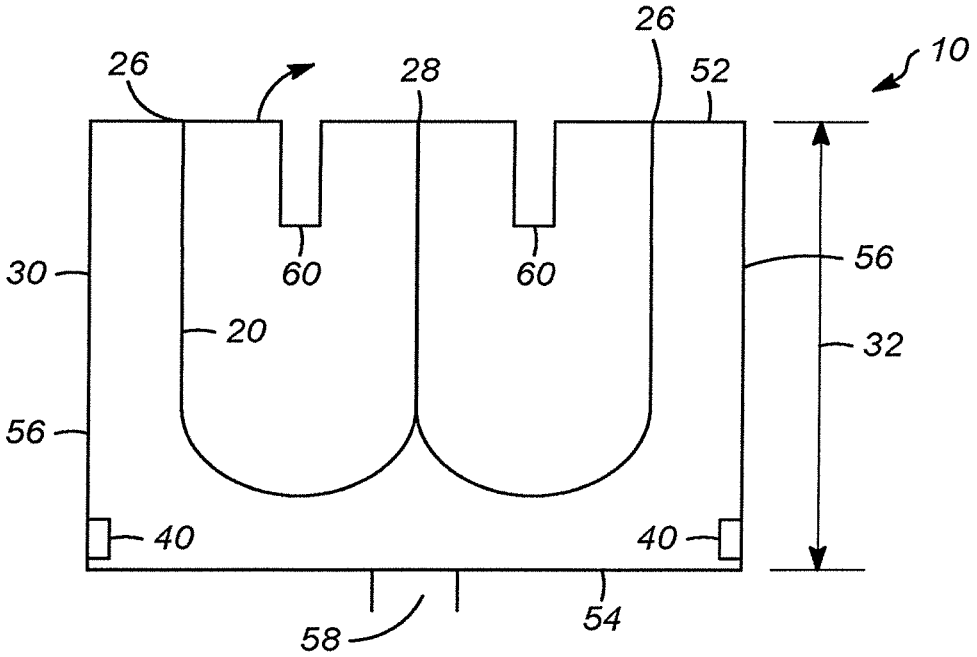
FIG. 3 shows an embodiment of the invention with the fired heater having an upper surface with projections into the fired heater volume.

In another embodiment, as shown in FIG. 3, the apparatus 10 includes a shell 30 having a first end 52, a second end 54 disposed opposite the first end 52, and sides 56 connecting the first end 52 and the second end 54. This shell 30 encloses a volume or space. The apparatus includes at least one W-shaped process tube 20, or coil, having two inlet ports 26 and one outlet port 28 disposed on the first end 52. The apparatus includes a flue gas outlet 58 disposed on the second end 54 of the shell 30. The apparatus includes at least two burners 40 disposed on the sides 56 of the shell 30, and in opposition to each other. The first end 52 of the shell 30 comprises at least two projections 60 from the first end 52 and where the projections extend into the enclose space of the shell 30. The projections 60 are disposed between the inlet ports 26 to the process tube 20 and the outlet port 28.

The sides have a height 32, and the projections 60 extend between 2% and 15% of the height from the first end. The apparatus 10 is a fired heater, and for processes in the hydrocarbon industry, the apparatus is a large item. In one embodiment, the first end 52 is the upper surface of the shell 30. For fired heaters in the hydrocarbon industry, the fired heaters can have heights between 12 m and 25 m. This leads to projections between 0.25 m and 4 m from the first end 52 of the shell, with preferred projection lengths between 0.3 m and 3 m.

Figure 4:
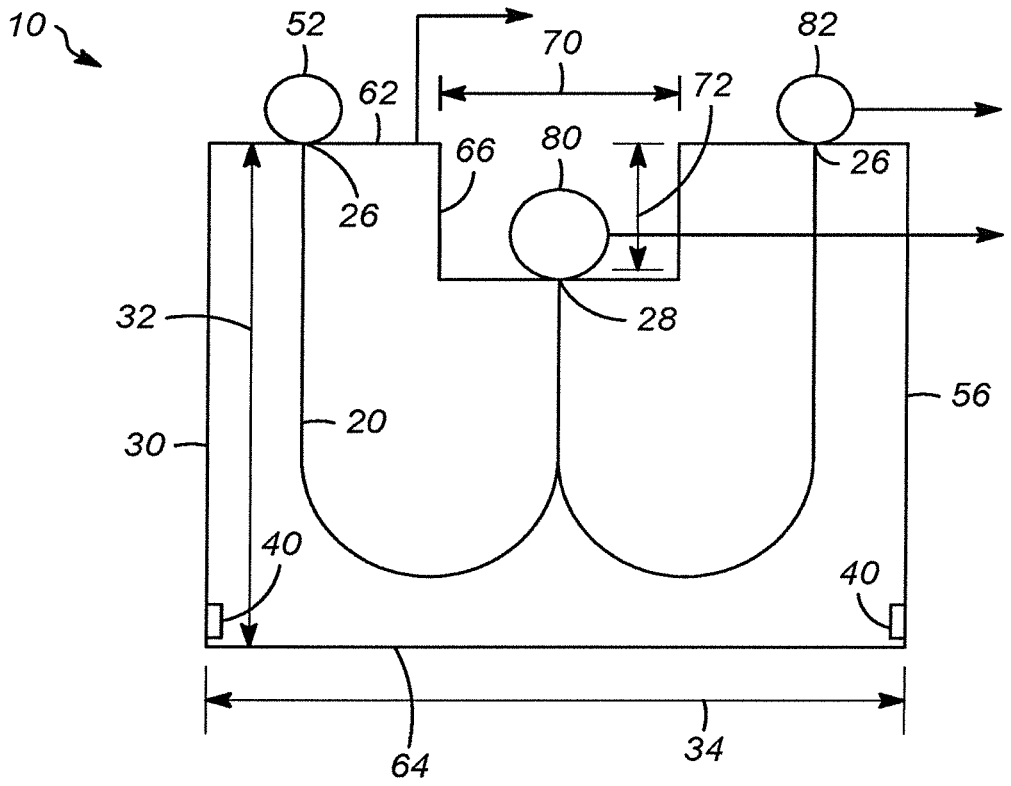
FIG. 4 shows an embodiment of the invention wherein the surface with the outlet of the process tube is mounted on the projection of the surface.

In another embodiment, the apparatus, as shown in FIG. 4, the apparatus 10 includes a shell 30 having a height 32, a width 34, sides 56, an upper surface 62, and a lower surface 64, thereby defining a volume. The apparatus further includes combustion fluid inlets for burners 40. The burners 40 are disposed on opposite sides of the shell 30. The apparatus includes at least one process tube 20, or coil, having two inlet ports 26 and one outlet port 28 disposed with in the shell 30. The inlet ports 26 and outlet port of each process tube 20 is disposed on the upper surface 62 of the shell. The upper surface 62 comprises a surface with a projection 66 into the volume of the shell 30. The projection 66 has a width 70 and depth 72, wherein the depth projects into the volume, and the depth 72 of the projection 66 extends at least 2% of the height 30 from the upper surface 62, and wherein the process coil outlet port 28 is disposed on the projection 66. In one variation, the projection has a width 70 at least 10% of the width 34 of the shell 30. The outlet port 28 is in fluid communication with an outlet manifold 80, and the inlet ports 26 are in fluid communication with inlet manifolds 82. The outlet manifold 80 is in fluid communication with a reactor.

In a preferred variation of this embodiment, the width 70 of the projection 66 is between 10% and 50% of the width 34 of the shell. And in a preferred variation, the projection 66 extends into the volume of the apparatus between 3% and 15% of the height 32 of the shell.

Figure 5:
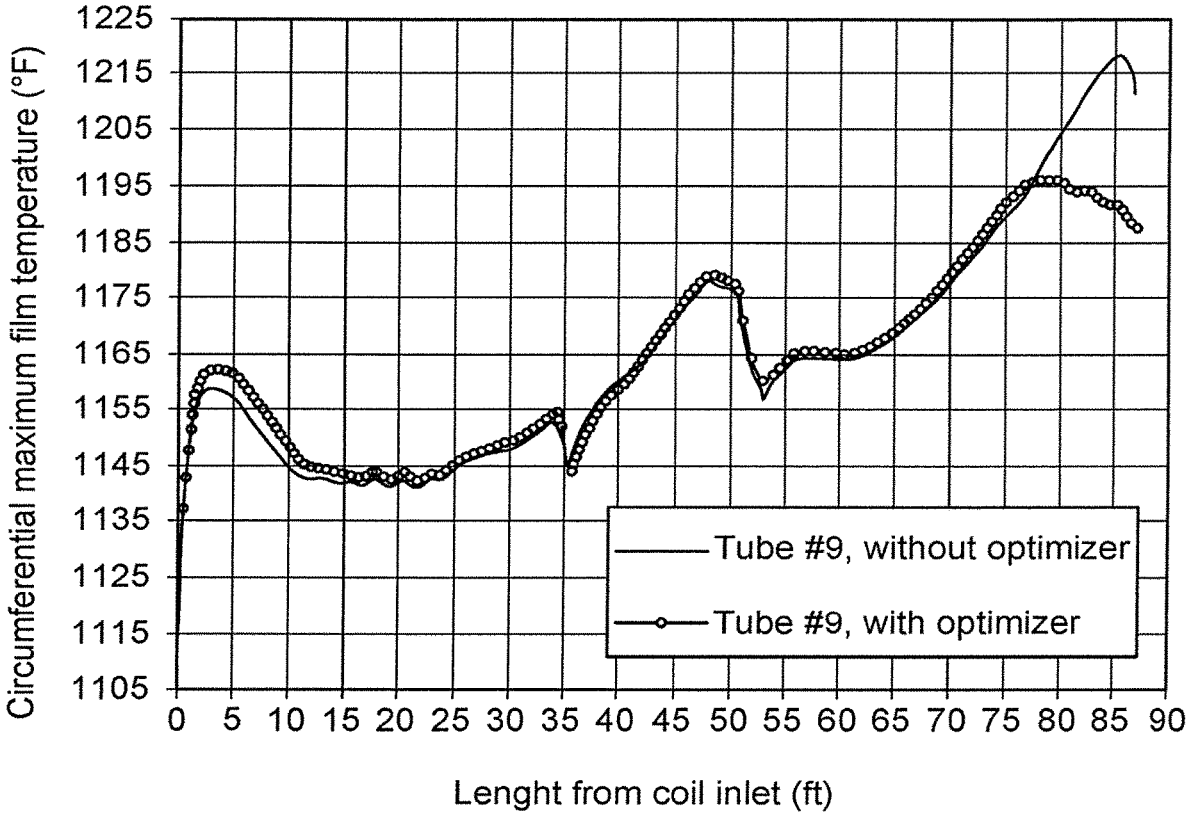
FIG. 5 shows the effect of the fired heater baffles on the maximum film temperature of the process coils.

The process fluid temperature reaches a peak at the outlet. The peak film temperature on the process tubes is also found in the area of the outlet. The peak film temperatures can exceed desired temperature limits where the process fluid can then experience undesired thermal reactions, such as cracking. The film temperature optimizers create low velocity and temperature zones which lowers the heat flux in the region of the process tube outlets. Consequently, this reduces the peak film temperature. The result can be seen in FIG. 5 and a reduction in the peak film temperature is about 20° F. (11° C.).

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. An apparatus for a process fired heater comprising:

a shell having a first end, a second end positioned opposite the first end, and sides connecting the first end and second end, and wherein the sides and ends enclose a space;

at least one w-shaped process tube comprising two inlet ports and one outlet port, and disposed within the shell and having the two inlet ports and the outlet port on the first end;

a flue gas outlet disposed in the second end; and at least two burners disposed on the sides of the shell;

wherein the first end of the shell comprises at least two projections from the first end and the projections extend into the enclosed space, and wherein a first of the at least two projections is interposed between a first inlet port of the two inlet ports to the process tube and the outlet port for the process tube, and wherein the second of the at least two projections is interposed between a second inlet port of the two inlet ports to the process tube and the outlet port for the process tube.

2. The apparatus of claim 1 wherein the shell has a substantially rectangular prismatic shape, with a height, a depth and a width, and wherein the process tube extend at least 70% of the height, and the at least one w-shaped process tube is arranged across the width with a central tube of the w-shaped process tube arranged along an axis that is in the middle of the width of the shell, and wherein outer tubes w-shaped process tube are arranged in a position between 5% and 95% of a distance of a half-width of the shell.

3. The apparatus of claim 1 further comprising an insulating layer on an upper surface of the space.

4. The apparatus of claim 1 wherein the shell has a substantially rectangular prismatic shape, with a height, a depth and a width, and wherein the burners are disposed on opposite sides of the width of the shell, and wherein the burners are disposed within 10% of the height of the from a bottom of the shell.

5. The apparatus of claim 1 wherein the shell has a substantially rectangular prismatic shape, with a height, a depth and a width, and wherein the burners are disposed on opposite sides of the depth of the shell.

6. The apparatus of claim 1 wherein the at least two projections extend from an upper surface between 2% and 15% of a height of the space between the upper surface and a lower surface.

7. The apparatus of claim 6 wherein the at least two projections extend from the upper surface between 2% and 10% of the height of the space between the upper surface and the lower surface.

8. The apparatus of claim 7 wherein the at least two projections extend from the upper surface between 3% and 9% of the height of the space between the upper surface and the lower surface.

9. The apparatus of claim 1 wherein the at least two burners are disposed on opposite sides of the shell.

10. The apparatus of claim 1 wherein the shell has a height between 12 m and 25 m, and wherein the at least two projections have a height of between 0.3 m and 3 m.

11. The apparatus of claim 10 wherein the first end is an upper surface of the shell.

12. The apparatus of claim 11, wherein the upper surface further includes a refractory material on the upper surface, inside the shell and abutting the at least two projections.

* * * * *